US007061964B2

(12) United States Patent
Kawasaki et al.

(10) Patent No.: US 7,061,964 B2
(45) Date of Patent: Jun. 13, 2006

(54) ELECTROSTATIC LEVITATION FURNANCE

(75) Inventors: Kazunori Kawasaki, Tokyo (JP); Hiroaki Asahi, Tokyo (JP); Shoji Muramatsu, Tokyo (JP); Tetsuya Takada, Tokyo (JP)

(73) Assignee: IHI Aerospace Co., Ltd., Tokyo (JP)

( * ) Notice: Subject to any disclaimer, the term of this patent is extended or adjusted under 35 U.S.C. 154(b) by 0 days.

(21) Appl. No.: 10/491,227

(22) PCT Filed: Sep. 27, 2002

(86) PCT No.: PCT/JP02/10045

§ 371 (c)(1),
(2), (4) Date: Sep. 27, 2004

(87) PCT Pub. No.: WO03/029742

PCT Pub. Date: Apr. 10, 2003

(65) Prior Publication Data

US 2005/0024808 A1 Feb. 3, 2005

(30) Foreign Application Priority Data

Sep. 28, 2001 (JP) ..... 2001-299652

(51) Int. Cl.
*H05B 11/00* (2006.01)

(52) U.S. Cl. ..... 373/2; 373/10; 361/144

(58) Field of Classification Search ..... 310/309, 310/311, 317, 366; 361/236, 144, 147; 373/2, 373/10, 60, 61–63; 219/647–648, 121.6, 219/121.86, 123, 124.1, 124.22, 124.33; 73/504.18, 514.18, 514.19
See application file for complete search history.

(56) References Cited

U.S. PATENT DOCUMENTS 3,965,753 A * 6/1976 Browning, Jr. ..... 73/504.18
4,896,849 A * 1/1990 Moynihan ..... 373/10
5,015,906 A * 5/1991 Cho et al. ..... 310/309
5,155,651 A 10/1992 Yoda et al.

FOREIGN PATENT DOCUMENTS

EP 1434021 A1 * 6/2004

* cited by examiner

*Primary Examiner*—Tu Hoang
(74) *Attorney, Agent, or Firm*—Sughrue Mion, PLLC

(57) ABSTRACT

An electrostatic levitation furnace is improved by providing three pairs of electrodes opposed to each other respectively on three axes perpendicularly intercepting each other at a position where the sample is to be levitated in the vacuum chamber, and disposing a plurality of access ports, which are directed to the position of the sample, to the vacuum chamber tree-dimensionally, whereby the accessible direction against the sample is diversified, it becomes possible to improve the degree of freedom in distribution of various apparatuses and easily cope with increase of apparatuses.

11 Claims, 11 Drawing Sheets

(a)

(b)

(a)

(b)

ELECTROSTATIC LEVITATION FURNANCE

This is a National Stage entry of Application No. PCT/JP02/10045 filed Sep. 27, 2002; the disclosure of which is incorporated herein by reference.

TECHNICAL FIELD

This invention relates to an electrostatic levitation furnace, which is used for suspending a charged sample in a levitation state in an electrostatic field generated between electrodes and subjecting the sample to heating process.

BACKGROUND ART

There is an electrostatic levitation furnace as a conventional levitation furnace, which is provided with a flat and nearly cylindrical shaped vacuum chamber, a pair of main electrodes disposed on Z-axis that is an axis of this vacuum chamber, a pair of auxiliary electrodes respectively disposed on X-axis and Y-axis intersecting perpendicularly to the Z-axis, and a plurality of access ports disposed two-dimensionally in a periphery of the vacuum chamber at predetermined spaces. The respective access ports are equipped with various apparatuses, such as a laser irradiator for heating the sample, a position detector for the sample, a thermal measuring device for the sample, an illuminator, a camera and so on.

In the electrostatic levitation furnace described above, the sample charged between main electrodes is charged by electrode contact, ultraviolet irradiation or heating, and made in the levitation state by the electrostatic field generated between main electrodes. In this time, the sample is held in the predetermined position by controlling electric potential between main electrodes and between auxiliary electrodes, and the sample is heated and molten by irradiating laser beams thereon. It is possible to generate a crystal without external interference by cooling and solidifying the sample heated and molten in this manner.

Additionally, although there is a furnace designed so as to levitate the sample by using an acoustic wave or an electromagnetic method as the furnace for making the sample in the levitation state, it is necessary to introduce a gaseous body into the furnace in a case of using the acoustic wave, so that the sample may be influenced by the gaseous body, and the sample is confined to a conductive body in a case of using the electromagnetic method. As compared with above, the electrostatic levitation furnace has the advantage in that the furnace can be applied also to the sample other than the magnetic body without the influence of the gaseous body because of making the inside of the furnace vacuous.

However, in the aforementioned conventional electrostatic levitation furnace, the main electrodes is disposed on the axis of the vacuum chamber and the access ports is disposed two-dimensionally along the outer periphery of the vacuum chamber, therefore there are problems as follow.

① It is difficult to increase the number of the apparatuses for access and distribute these apparatuses since the accessible direction against the sample is substantially limited within only one plane and the auxiliary electrodes are also disposed on this plane.

② The auxiliary electrodes of which electrostatic field intensity is low as compared with the main electrodes cannot but be used for reasons of distributing the various apparatuses, so that controlling forces in the directions of X and Y-axes becomes weak.

③ If the access ports are increased in number according to demand of access against the sample, the outer diameter of the vacuum chamber becomes larger and the equipment becomes larger in the whole body because the vacuum system becomes necessary to increase the capacity following this. In a case of scaling up of the equipment in the whole body as mentioned above, the distance from the sample becomes longer, so that the access against the sample becomes difficult, furthermore it becomes improper to be used in the spacecraft in which there is a severe limitation in size and weight.

④ It is difficult to heat the sample uniformly because the irradiating direction of laser beams is also restricted within one plane.

Further, there is also a problem in that the respective electrodes are fixed to the vacuum chamber in the conventional electrostatic levitation furnace and it is not possible to change the space between the electrodes and the size of the electrodes according to size of the sample or so.

DISCLOSURE OF THE INVENTION

The present invention has been made in view of the aforementioned problem in the conventional arts, and it is an object to provide an electrostatic levitation furnace, which is possible to increase the accessible direction to the sample, thereby enabling realization of extension of the various apparatuses and improvement of heating functions for the sample in spite of the body small in size.

The electrostatic levitation furnace according to this invention is a furnace for generating electrostatic field between electrodes disposed in a vacuum chamber and making a charged sample into a levitation state in the electrostatic field between the electrodes, and characterized by comprising three pairs of electrodes opposed to each other respectively on three axes perpendicularly intercepting each other at a position where the sample is to be levitated in the vacuum chamber and a plurality of access ports disposed three-dimensionally to the vacuum chamber and directed to the position of the levitating sample.

In the aforementioned electrostatic levitation furnace, three pairs of electrodes are provided in the vacuum chamber, and each of pairs of electrodes are opposed to each other on one of three axes perpendicularly intercepting each other. The sample is made into the levitation state by the electrostatic field generated between these electrodes and maintained in the predetermined position by controlling electric potential between the respective electrodes. Further, the access ports directed to the position of the sample are three-dimensionally disposed to the vacuum chamber, and these access ports are provided with various apparatus, such as a laser irradiator for heating the sample, a position detector for the sample, a thermal measuring device for the sample, an illuminator, a camera and the like. The accessible direction to the sample becomes multiple differing from the conventional furnace by disposing the access ports tree-dimensionally as mentioned above, whereby it becomes easy to avoid interference between the apparatuses and the electrodes, the degree of freedom in distribution of the apparatuses is increased and the extension of the apparatuses becomes easier to be dealt with.

The electrostatic levitation furnace according to this invention is also characterized by making the three pairs of electrodes equivalent in their electrostatic field intensity.

In the furnace as mentioned above, three pairs of electrodes generate electrostatic fields equivalent in their intensity. Namely, the electrodes can be disposed without severe restriction owing to the distribution of various apparatuses when the accessible direction against the sample becomes more multiple, so that three pair of the electrodes equivalent in electrostatic field intensity become possible to be introduced. Whereby, controlling forces in the directions of three axes caused by the respective electrodes becomes uniform and the sample is securely maintained at the predetermined position in the levitation state.

The electrostatic levitation furnace according to this invention is further characterized by disposing a detachable cage in the vacuum chamber and providing the respective electrodes to this cage.

In the above-mentioned electrostatic levitation furnace, the cage provided with the electrodes are attached to the vacuum chamber, therefore the respective electrodes may be disposed in the predetermined positions in the vacuum chamber. Furthermore, since the cage is detachable from the vacuum chamber, it is possible to selectively use the plural cages according to size of the sample or so, by preparing the plural cages provided with the electrodes differing in size and (or) space between the opposite electrodes in advance.

Further, the electrostatic levitation furnace according to this invention is characterized by providing the respective electrodes detachably from the cage.

In the aforementioned electrostatic levitation furnace, it is possible to selectively attach the electrodes differing in size and (or) space between the opposite electrodes against the common cage because the respective electrodes are detachably from the cage.

Furthermore, the electrostatic levitation furnace according to this invention is characterized by providing power terminals to the cage.

In the aforementioned electrostatic levitation furnace, the cage may be attached with the electrodes or the apparatuses required for power supply since the cage is provided with the power terminals.

The electrostatic levitation furnace according to this invention is further characterized by providing the laser irradiators for irradiating laser beams against the sample at respective points corresponding to apexes of a triangular pyramid having the center coincides with the position where the sample is to be levitated.

In the aforementioned furnace, it becomes possible to arrange the laser irradiators as described above, because the accessible direction to the sample becomes multiple. So that, the sample is heated uniformly by irradiating laser beams to the sample from the four laser irradiators situated at the respective apexes of the triangular pyramid.

The electrostatic levitation furnace according to this invention is also characterized by providing the laser irradiator for irradiating laser beams against the sample at one of respective electrodes.

In the furnace as mentioned above, the laser irradiator is provided to one of electrodes, for example, to the upper electrode on the vertical axis in a case of subjecting the sample to the heating process in the gravitational field. The sample is heated and charged by irradiating laser beams from the laser irradiator, and successively levitated according to the electrostatic field generated between the electrodes.

The electrostatic levitation furnace according to this invention is further characterized by providing a chuck for holding the sample to be released between the electrodes, and the chuck is provided with a pair of holder pieces energized in the closing direction for pinching the sample therebetween.

In the furnace as mentioned above, the sample is held with the chuck beforehand, and is made to be released from the chuck as the positively charged sample moves toward the negative electrode, especially in application in the zero-gravity space (including micro-gravity space). In a case of, for example, using a chuck of opening type, the contact between the sample and the chuck on the whole is not always uniform, therefore there is high possibility of providing rotation to the released sample according to uneven contact of the sample with the opening chuck. If the sample is rotated, it becomes impossible to obtain uniform composition owing to centrifugal force caused by the rotation. Therefore, in this electrostatic levitation furnace, the sample is kept to be held between pair of holder pieces of the chuck energized in the closing direction and the pair of holder pieces is closed with the movement of the charged sample. The sample is released between the electrodes without rotation by activating the pair of holder pieces in the closing direction as mentioned above.

Furthermore, the electrostatic levitation furnace according to this invention is characterized by disposing the laser irradiator to the electrode on the lower side between vertically opposed electrodes in the gravitational field.

In the aforementioned electrostatic levitation furnace, which is provided with the electrodes opposed in the vertical direction in the gravitational field, laser beams are irradiated to the sample from the laser irradiator disposed to the lower electrode. Concretely, in a case where the principal element of the sample is high-melting point metal for example, the sample is heated up to a temperature lower than the melting point (1200° C. or so, for example) by irradiating laser beams to the sample from the lower side, thereby removing low-melting elements contained in the sample and electrifying the sample. After this, the sample is made into the levitation state between electrodes as it is or after cooling, and then the sample is heated into melting state by irradiating laser beams. In such the case of making the sample into the levitation state by irradiating laser beams from under side of the sample, pressure of laser acts in the direction in which the gravity is cancelled, and the charged state of the sample is maintained efficiently.

The electrostatic levitation furnace according to this invention is also characterized by forming the top end face of the lower electrode in a hemi-spherically concave shape.

In the aforementioned furnace having the lower electrode with a hemi-spherically concave face on the top end, radiant heat is transferred efficiently toward the sample by the top end face (concave shape) of the electrode at the time of heating the sample with laser beams.

Moreover, the electrostatic levitation furnace according to this invention is characterized by providing a net-like shaped holding means for placing the sample to the lower electrode.

In the aforementioned furnace of which electrode on the lower side is equipped with the net-like shaped holding means for placing the sample, a net made of, for example, tungsten is applied as the holding means. In this electrostatic levitation furnace, the electrode face is prevented from damage in the high-temperature environment by heating the sample placed on the holding means with laser beams.

BRIEF DESCRIPTION OF THE DRAWING

FIG. 4(*b*) is a sectional view of the necessitated portion illustrating a state of supplying the sample;

BEST MODE FOR CARRYING OUT THE INVENTION

An example of the electrostatic levitation furnace according to this invention will be described below on basis of the drawings. The electrostatic levitation furnace according to this invention is of course not limited only to the example as described blow in the details of construction of the respective parts.

Figure 1:
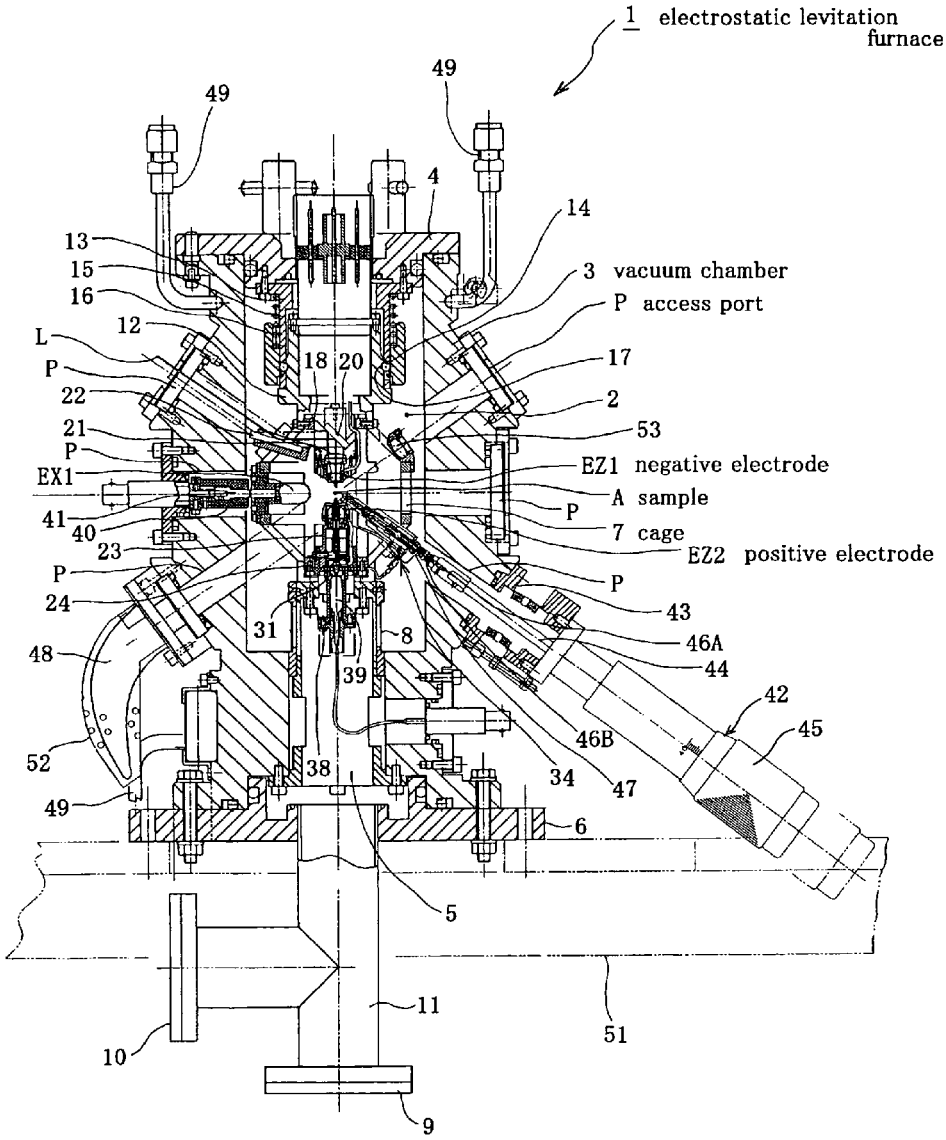
FIG. 1 is a sectional view explaining an example of the electrostatic levitation furnace according to this invention.
Figure 2:
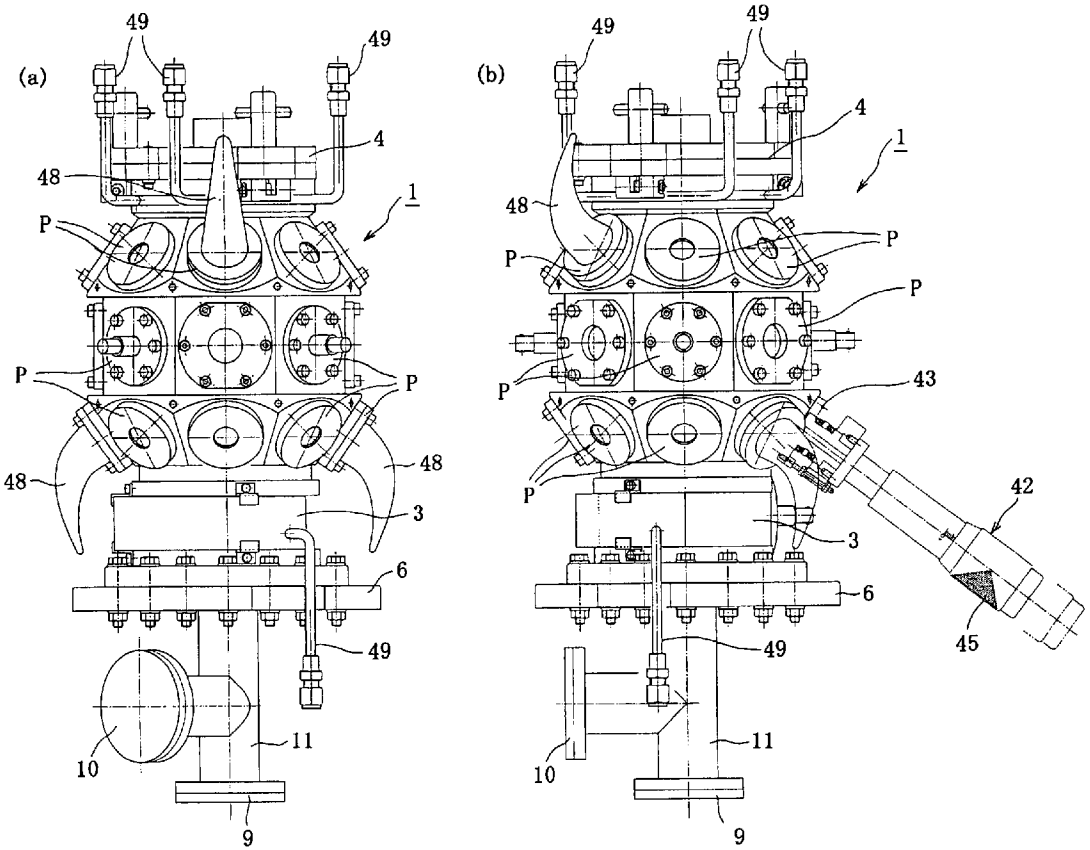
FIGS. 2(*a*) and (*b*) are side views of the electrostatic levitation furnace shown in FIG. 1 differing in the observation angle from each other.
Figure 3:
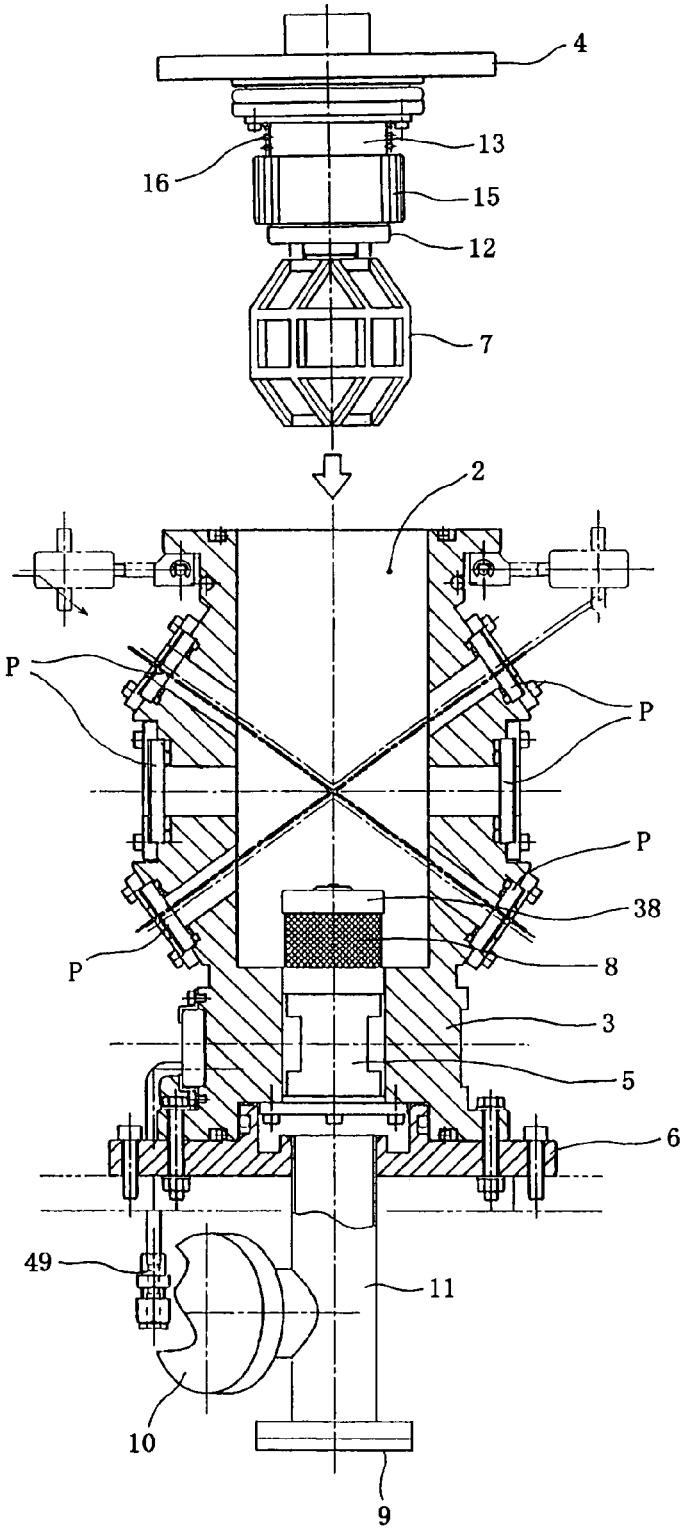
FIG. 3 is a sectional view illustrating assembling procedure of the cage against the vacuum chamber.

An electrostatic levitation furnace 1 shown in FIGS. 1 to 3 is provided with a vacuum chamber 3 forming a space 2 having nearly cylindrical shape opened in the vertical direction, a cover plate 4 for blocking the upper side of the vacuum chamber 3 in airtight, an electrode-base fixing pedestal 5 having a pipe-like shape and inset coaxially from lower side of the vacuum chamber 3, and a fitting flange 6 fixed to the underside of the vacuum chamber 3 in airtight, and this furnace 1 is secured to a base plate 51 shown with two-dot chain lines through the fitting flange 6.

The vacuum chamber 3 has an octagonal section and a sidewall divided into three parts in the vertical direction, therefore the vacuum chamber 3 is formed with 24 faces on the sidewall, and access ports P are disposed on the respective faces of the sidewall. Further, the cover plate 4 is equipped with a cage 7 disposed with openings in accordance with the distribution of the respective access ports P.

The cage 7 is detachable together with the cover plate 4 against the vacuum chamber 3, and maintained inside of the respective access ports P in the space 2 in the state of fixing the cover plate 4 to the vacuum chamber 3. In this state, the center of the cage 7 agree with a position in which a sample A is to be levitated, and the respective access ports P are directed to the position of the levitating sample A and disposed in tree-dimensional.

The electrode-base fixing pedestal 5 is provided with a filter 8 at outer periphery of the top end protruding into the space 2, and the space 2 communicates with outside of the vacuum chamber 3 through the filter 8. The fitting flange 6 is equipped with a pipe 11 including a connecting portion 9 to a vacuum pump and a connecting portion 10 to an inactive gas source. The pipe 11 is situated coaxially with the electrode-base fixing pedestal 5 and communicates with the space 2 through the inside of the electrode-base fixing pedestal 5.

The cage 7 is provided with a plug 12 and detachable from a socket 13 secured to the under face of the cover plate 4. The plug 12 and the socket 13 form a well-known connector used for the fluid coupling or so.

Namely, the socket 13 is formed in a cylindrical shape and provided with the proper number of engaging balls 14 freely going in and out inside thereof, and a sleeve 16 fitted thereon and energized downwardly by a spring 15. On the other side, the plug 12 is formed with a depression 17 corresponding to the engaging balls 14 on the outer periphery thereof. The plug 12 and the socket 13 are designed so as to keep the connected state by inserting the plug 12 inside of the socket 13 as shown in FIG. 1, engaging the balls 14 projecting inside of the socket 13 into the depression 17 of the plug 12 and restricting the engaging balls 14 in the projecting state with the sleeve 16. In this time, the restriction of the engaging balls 14 is cancelled by moving the sleeve 16 upwardly against elasticity of the spring 15, and the plug 12 can be disengaged from the socket 13.

Figure 4:
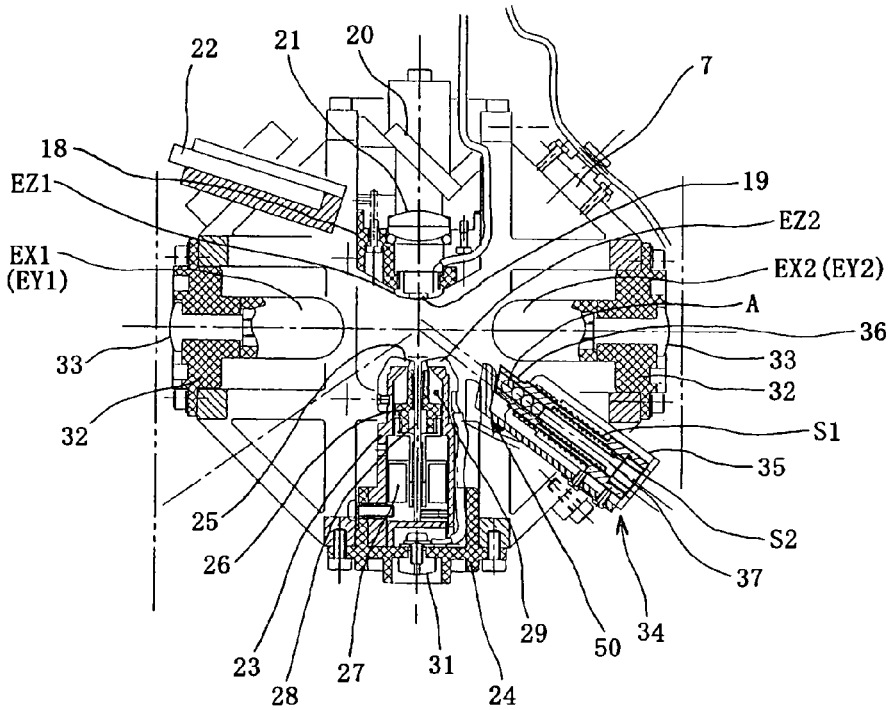
FIG. 4(*a*) is a sectional view of the cage at the position of the sample supplier.
Figure 4:
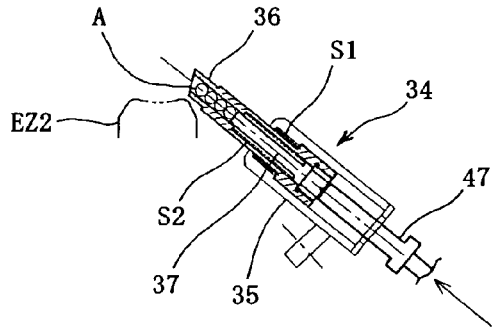
Figure 5:
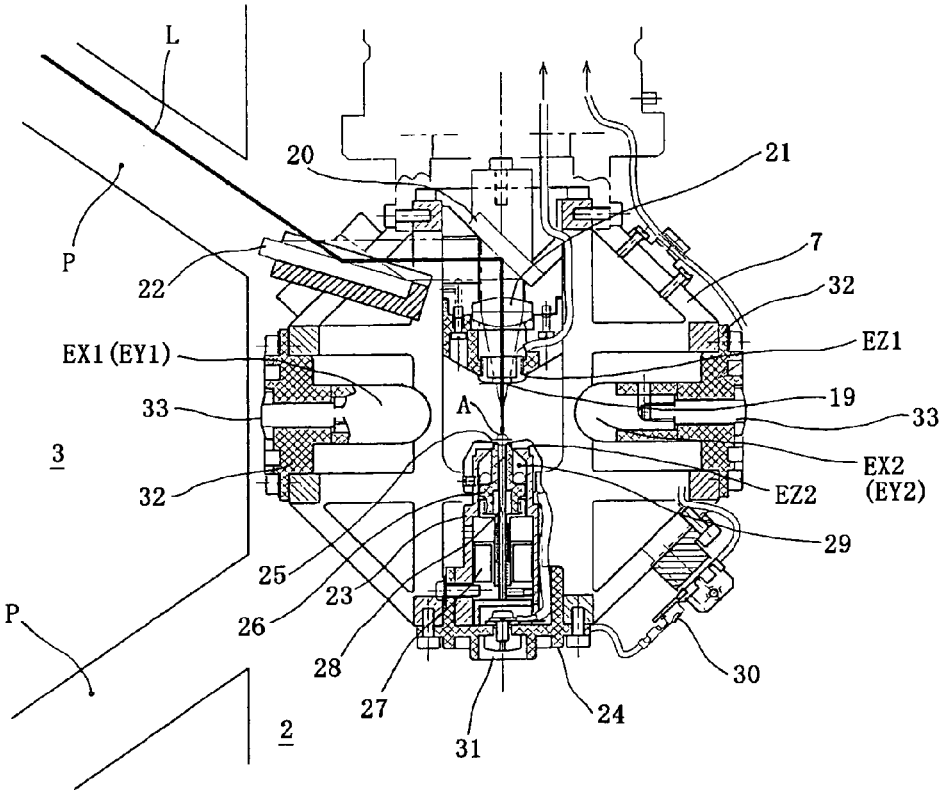
FIG. 5 is a sectional view of the cage illustrating a laser beam path on the Z-axis.

The cage 7 is disposed with three pair of electrodes opposed to each other respectively on three axes perpendicularly intercepting each other at the position where the sample A is kept in the levitation state as shown also in FIG. 4 and FIG. 5. In this example, the upper electrode is denoted as a negative electrode EZ1 and the lower electrode is denoted as a positive electrode EZ2 on vertical Z-axis. Electrodes of one side are denoted as negative electrodes EX1 and EY1 and the other electrodes are denoted as positive electrodes EX2 and EY2 on horizontal X and Y-axes, respectively. All of three pairs of electrodes are equivalent in their electric intensity and detachable from the cage 7 at will.

The negative electrode EZ1 on the Z-axis is fitted to an insulating holder 18 screwed to the cage 7, and connected with the power source via a path passing through the cover plate 4. Further, the negative electrode EZ1 is provided with an opening 19 that works as a laser irradiator at the center thereof. Correspondingly, a reflector 20 and a condenser lens 21 forming an optical path are housed in the insulating holder 18, and the cage 7 is attached with another reflector 22 similarly forming the optical path.

As shown in FIG. 5, laser beams L passed through the access port P are reflected by both the reflectors 22 and 20 and irradiated to the sample A through the opening 19 of the negative electrode EZ1 after being collected by the condenser lens 21. In this example, laser beams L irradiated from the opening 19 are used for heating and electrifying, whereby the sample A is heated and charged.

The positive electrode EZ2 on the Z-axis is similarly fitted to an insulating holder 23. The insulating holder 23 is screwed against an insulating base 24 fixed to the cage 7 with bolts. The positive electrode EZ2 has the upper face formed in a concave shape and is provided with an aperture 25 at the center of the concave face for passing the sample A. Correspondingly, the insulating holder 23 serves also as a collecting receptacle and is provided with a ceramic shutter 26 held at the upper limit by a spring, a solenoid 27 forming an electromagnet for moving the shutter 26 to the lower limit and a control pin 28 inserted on the axis of the shutter 26.

The shutter 26 forms a ring-shaped housing space 29 together with the insulating holder 23, and is so designed as to block the aperture 25 of the positive electrode EZ2 with the upper end thereof at the time of locating in the upper limit. The control pin 28 is secured to the insulating holder 23, the top end formed with a slope 28*a* of the control pin 28 is situated on a lower side of the aperture 25 and formed so as to protrude from the upper end of the shutter 26 when the shutter 26 moves to the lower limit. The solenoid 27 is connected with power terminals 30 provided to the cage 7. The power terminals 30 connected to the power source via the path passing through the cover plate 4 similarly to the aforementioned negative electrode EZ1. The collecting operation of the sample A will be described later.

The above-mentioned positive electrode EZ2 is connected with a conductive part 31 provided to the center of the under face of the insulating base 24. Additionally, the insulating base 24 is formed with irregularities by using suitable ribs on the outer surface thereof and the insulation performance is further improved by increasing exterior distance from the conductive part 31 with high voltage to the cage 7 with zero-potential because a high-tension electric power is used in this electrostatic levitation furnace 1. Furthermore, all of the respective electrodes EX1, EX2, EY1 and EY2 on the X and Y-axes are fitted to insulating holders 32 screwed to the cage 7 and provides with conductive parts 33 exposed at base ends of the insulating holders 32, respectively.

Moreover, the cage 7 is fitted with a sample supplier 34 for supplying the sample A to the upper face of the positive electrode EZ2 on the Z-axis. The sample supplier 34 is provided with an outer cylinder 35 secured to the cage 7, an inner cylinder 36 inserted in the outer cylinder 35 and an injection pin 37 inserted in the inner cylinder 36, and a plurality of the spherical sample A is contained in the inner cylinder 36. The inner cylinder 36 is held at the receding position by a first spring S1 intervening between the outer cylinder 35 and the inner cylinder 36, and the injection pin 37 is similarly held at the receding position by a second spring S2 intervening between the inner cylinder 36 and the injection pin 37.

In this time, the second spring S2 has larger spring constant as compared with the first spring S2. Further, the outer cylinder 35 is equipped with a cover 50 for covering and uncovering the top end of the inner cylinders 36. The cover 50 has elasticity enough to carry out the covering and uncovering action and is formed with heat-resisting resin. The outer cylinder 35, the inner cylinder 36, the first and second springs S1 and S2, and the injection pin 37 are assembled in a coaxial state so as to be smoothly actuated in the axial direction by a manipulator as described later. The supplying operation of the sample A will be described later.

The positive electrode EZ2 on the Z-axis, the respective electrodes EX1, EX2, EY1, EY2 on the X and Y-axes and the sample supplier 34 as described above are attached with an electrode base and the manipulator on the side of vacuum chamber 3.

The aforementioned electrode-base fixing pedestal 5 is fixed with an electrode base 38, which is provided with a power-leading terminal 39 corresponding to the conductive part 31 of the insulating base 24. Furthermore, ports corresponding to the respective electrodes EX1, EX2, EY1, EY2 on the X and Y-axes among the aforementioned access ports P are fixed with electrode bases 40 respectively, and the respective electrode bases 40 are attached with power-leading terminals 41 corresponding to the conductive parts 33 of the respective electrodes EX1, EX2, EY1 and EY2 in a state of being elastically held so as to protrude the top ends of them. These power-leading terminals 39 and 41 are connected to the power source on the outside of the drawings.

Furthermore, a port corresponding to the sample supplier 34 among the respective access ports P is installed with a manipulator 42. The manipulator 42 is provided with a fixing member 43, an operational rod 44 inserted slidably into the fixing member 43 and an operating knob 45 for moving the operational rod 44 in the axial direction, and the operational rod 44 is attached with a pusher rod 47 elastically held by a guide pin 46A and a spring 46B coaxially in the axial direction.

When the above-mentioned electrode bases 38, 40 and the manipulator 42 are fitted to the vacuum chamber 3 together with the cover plate 4, the conductive parts 31 and 33 of the respective electrodes EZ2, EX1, EX2, EY1 and EY2 come in contact with the power-leading terminals 39 and 41 respectively, whereby the respective electrodes EZ2, EX1, EX2, EY1 and EY2 are made into states connected with the power source, and the injection pin 37 of the sample supplier 34 and the pusher rod 47 of the manipulator 42 come to coincide on the same axis line. Namely, the respective apparatus on the inside and outside of the vacuum chamber 3 are made into operable interlocking states by merely fitting the cage 7 to the vacuum chamber 3.

Moreover, the access ports P are disposed with the laser irradiator for heating the sample A, and various apparatuses in addition to this, such as a position detector for the sample A, a thermal measuring device for the sample A, an illuminator and a camera. The access ports P disposed with these apparatuses are blocked up by windowpanes, and windows may be installed to some of access ports P for observing inside of the vacuum chamber 3.

Figure 8:
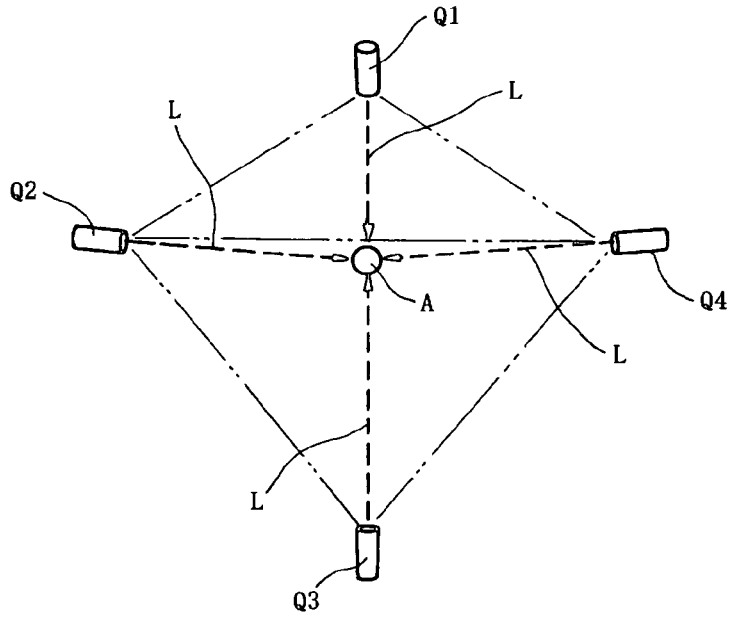
FIG. 8 is a schematic explanatory view showing distribution of the laser irradiators against the sample.

In this electrostatic levitation furnace 1, laser irradiators Q1 to Q4 are disposed at the points corresponding to the respective apexes of a triangular pyramid (shown with two-dot chain lines) having the center at the position where the sample A is to be levitated as shown in FIG. 8, for example. The access ports P opposed to the laser irradiators Q1 to Q4 among the aforementioned access ports P are provided with laser dumpers 48 for receiving laser beams deviating from the sample A, and the laser dumpers 48 are covered with safety covers 52 made of punching metal plates as shown in FIG. 1.

In this case, although the laser dumper is not equipped against laser beams irradiated from the opening 19 of the negative electrode EZ1 on the Z-axis since the positive electrode EZ2 is existing on the Z-axis, the laser emitter is controlled on basis of input signals from the a position detector for the sample A so as to discontinue the laser oscillation in a case where laser beams are likely to deviate from the sample A.

The electrostatic levitation furnace 1 is formed with a cooling jacket at proper parts of the vacuum chamber 3 for performing the heating process of the sample A, whereby a cooling fluid is circulated through cooling pipes 49 connected with this cooing jacket.

Next, an operation of the electrostatic levitation furnace 1 having the aforementioned construction will be explained below, concerning a case of subjecting the sample to heating process under the gravitational field.

First of all, the vacuum chamber 3 is evacuated to make the space 2 vacuous after setting the case 7 to the vacuum chamber 3 together with the cover plate 4 as shown in FIG. 1. Next, the sample A is cast to the positive electrode EZ2 by the manipulator 42. Namely, the operational rod 44 goes forward by operating the operation knob 45 of the maniulator 42, thereby pushing the injection pin 37 of the sample supplier 34 with the pusher rod 47 at the top end thereof. In this time, the inner cylinder 36 goes forward together with the injection pin 37 at the same time of compressing the first spring S1 in advance because the spring constant of the second spring S2 is larger than that of the first spring S1, the inner cylinder 36 thrust the cover 50 aside and further goes forward, consequently the uncovered top end of the inner cylinder 36 arrives by the side of the positive electrode EZ2 as shown in FIG. 4(*b*).

Figure 6:
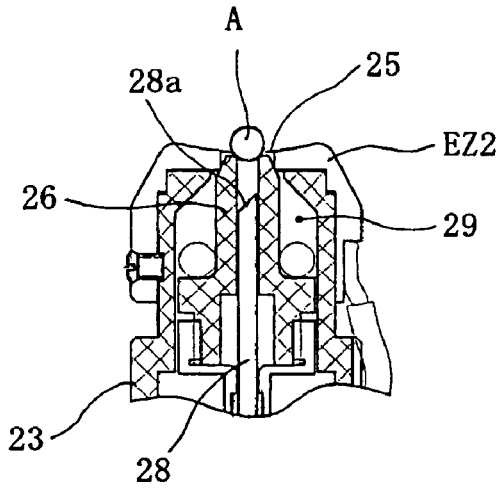
FIGS. 6(*a*) and (*b*) are sectional views explaining a process for collecting the sample.
Figure 6:
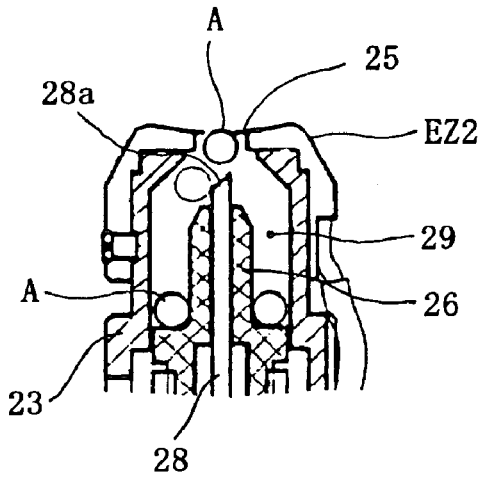

By making the operational rod 44 to go forward successively, the injection pin 37 goes forward at the same time of compressing the second spring S2, thereby releasing the sample A on the upper face of the positive electrode EZ2. The sample A to be released is a single one in this time. The released sample A is located at the upper end of the shutter 26 after rolling to the center as shown in FIG. 6(*a*), since the upper face of the positive electrode EZ2 is formed in the concave shape. After this, the sample supplier 43 is made a backward movement.

Subsequently, heating electrification is made for the sample A by irradiating laser beams toward the sample A from the opening 19 of the negative electrode EZ1 on the Z-axis. The sample A is levitated toward the negative electrode EZ1 on the upper side by electrifying the sample A positive in this manner. Although the heating electrification is carried out in this example, it is also possible to perform contact electrification through the positive electrode EZ2 by making the upper end part of the ceramic shutter 26 with a metal and forming an electric conductive path to the sample A from the positive electrode EZ2 on the Z-axis.

Figure 7:
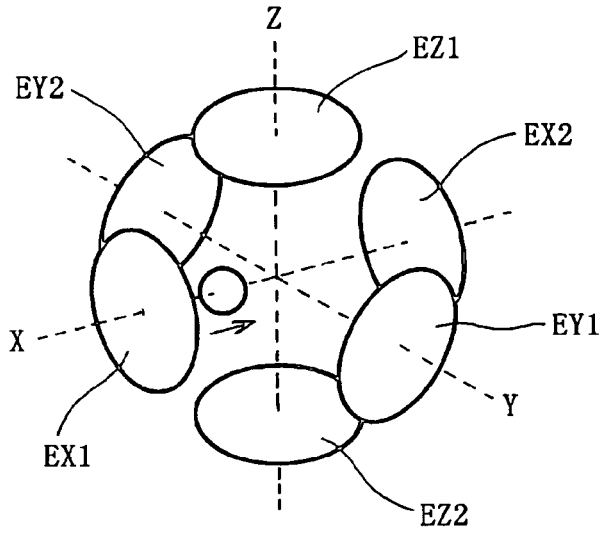
FIG. 7 is a schematic explanatory view showing the sample maintained in the levitation state.

Thereafter, the sample A is held floatingly at a certain height by the electrostatic field generated with the electrodes EZ1 and EZ2 on the Z-axis, and further held floatingly on the Z-axis by controlling the electrostatic field generated between the electrodes EX1 and EX2, EY1 and EY2 on the X and Y-axes as to the horizontal direction. For example, if the sample A deviates in the direction of X-axis as shown in FIG. 7, the sample A is returned onto the Z-axis by generating electrostatic field in the direction of X-axis and making electric potential zero in the direction of Y-axis.

In the state of holding the sample A at the center of the cage 7 as described above, the sample A is heated and molten by irradiating laser beams toward the sample A from the laser irradiators Q1 to Q4 disposed at the four places as shown in FIG. 8. In this time, the sample A can be heated uniformly because the laser irradiators Q1 to Q4 disposed at the places corresponding to the respective apexes of the triangular pyramid in this electrostatic levitation furnace 1. In the case of heating, it is also possible to irradiate laser beams for the electrification heating in addition to the laser beams from the four places. After that, the molten sample A is cooled and solidified while it is left in the levitation state. In such the manner, crystallization is performed in the sample A in a state of perfectly eliminating external interference in this electrostatic levitation furnace 1.

After completing the heating process for the sample A, the aperture 25 is opened by moving the shutter 26 to the lower limit through the solenoid 27, and then the sample A is made to fall by making the electric potential between the electrodes into zero. In this time, since the control pin 28 sticks out from the upper end of the shutter 26 and formed with the slope 28*a* at the top end thereof as shown in FIG. 6(*b*), the sample A is securely guided into one side by the slope 28*a* after passing through the aperture 25 and falls into the housing space 29. After that, the shutter 26 returns to the upper limit by interrupting current supply to the solenoid 27, and the collection of the sample A is completed. The sample A is certainly collected in the housing space 29 by dropping the sample A after opening the aperture 25 in this manner.

In the electrostatic levitation furnace 1, the plural number of the samples A are collected in the insulating holder 23 by repeating the aforementioned operation. This insulating holder 23 is used as a sample case in itself by removing it from the cage 7.

As mentioned above, in the electrostatic levitation furnace 1 of this example, the accessible direction against the sample A is multiple, such as the heating of the sample, the position detection, the temperature measurement, the illumination, the photographing and so on, in addition to the generation of the electrostatic field against the sample A from three directions, therefore it is possible to easily avoid the interference between the electrodes EZ1, EZ2, EX1, EX2, EY1, EY2 and the laser irradiators Q1 to Q4 or the other apparatuses, the degree of freedom is very high in distribution of the apparatuses in spite of the small-sized body and it is easy to deal with the increase of the apparatuses as compared with the case of accessing the sample on the same plane as described concerning the conventional electrostatic levitation furnace.

Further, it is possible to obtain the sufficient vacuum atmosphere even by the small-sized vacuum system according to miniaturization of the vacuum chamber 3, and it is easy to introduce, for example, the manipulator 42 because of short distance from the sample A.

Furthermore, the cage 7 is detachable from the inside of the vacuum chamber 3, the electrodes EZ1, EZ2, EX1, EX2, EY1 and EY2 are detachable from the cage 7, and the power terminals 30 are provided to the cage 7, therefore it is possible to change the space and the size of the electrodes in accordance with the size of the sample A or so, and the cage 7 can be disposed with the apparatuses required to be connected with the power source such as solenoid 27 for actuating the optical instruments such as the reflectors 20 and 22, the condenser lens 21 or so and the shutter 26, thereby simplifying the setting work of these apparatuses.

Especially, the cage 7 can be attached with condenser lenses 53 (partially shown in FIG. 1) for collecting laser beams L from the laser irradiators Q1 to Q4, and such the structure becomes very effective in order to irradiate laser beams. Namely, semiconductor laser is used for example in this electrostatic levitation furnace 1, laser beams from the laser emitter is conducted through an optical fiber tube and irradiated to the sample. In this case, laser beams radiated from the optical fiber tube has a tendency to diffuse. In a case of assumingly trying to irradiate such the laser beams to the sample A after collecting on the outside of the vacuum chamber 3, it is difficult to adjust the focus in accurate because of long distance from the sample A and the diameter of the spot becomes larger. Further, the laser beams pass the access port P in a concentrated state, accordingly the windowpane of the port P is required to be applied with a heat-resisting coating or the like.

As compared with the above, in this electrostatic levitation furnace 1, which is disposed with the condenser lenses 53 in the vicinity of the sample A, laser beams L radiated from the optical fiber tube is introduced in the access port P in a state as radiated, that is a state of not exerting severe influence on the windowpane or so, and the laser energy is centered in the sample A by collecting the laser beams L at the position sufficiently close to the sample A. The focusing against the sample A is simplified and the diameter of the beam spot also becomes smaller by disposing the condenser lenses 53 near by the sample A in the cage 7 as mentioned above, therefore the effective heating can be performed and the heat-resisting coating of the windowpane becomes unnecessary.

Furthermore, the electrostatic levitation furnace 1 has excellent functions in addition to the small-sized body as mentioned above, and it is suitable to be used in the space in which there is severe restriction in size and weight. In the application in space, that is in the non-gravity field, the electrostatic levitation furnace is to be used, which is equal to the aforementioned example substantially in the basic structure, but changed in the supplying means and the collecting means for the sample A.

Figure 9:
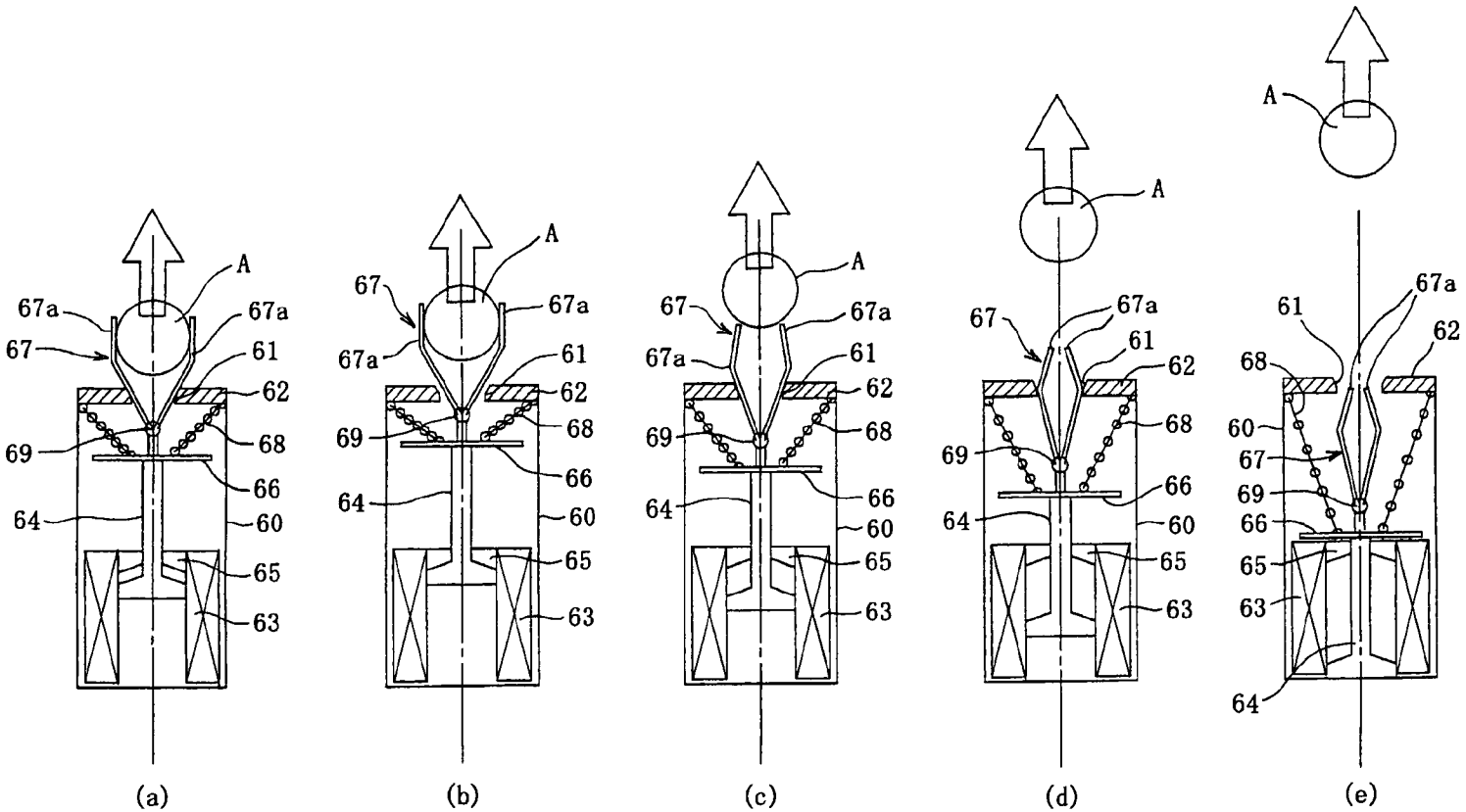
FIGS. 9(*a*)~(*e*) are sectional views explaining a process for releasing the sample.

FIG. 9 is a drawing for explaining another example of the supplying means of the sample A. The sample supplying means shown in FIG. 9 is installed with a cover 62 having an aperture 61 in the center thereof to the upper end of a cylindrical casing 60, and provided with a solenoid 63 forming an electromagnet, an iron core 65 disposed at the upper end of the solenoid 63, and a plunger 64 actuated by the solenoid 63 on the inside of the casing 60. The plunger 64 is provided with a chuck 67 having a spring receiver 66 and a pair of holder pieces 67*a* and 67*a* at the top end thereof, and a helical compression spring 68 is intervened between the cover 62 and the spring receiver 55 in the casing 60.

The chuck 67 is composed by connecting the pair of holder pieces 67*a* and 67*a* rotatably with each other through a pin 69, and so structured as to hold the sample A between holder pieces 67*a* and 67*a* protruding upwardly from the aperture 61 of the cover 62. In this time, the pair of holder pieces 67*a* and 67*a* is prevented to close by the sample A and energized downwardly by the helical compression spring 68 as shown in FIG. 9(*a*), accordingly they are in a state of being energized in the closing direction by contacting with an edge of the aperture 61, and hold the sample A in this state. The plunger 64 is situated in a position where a gap in the vertical direction exists between this plunger 64 and the iron core 65. The above-mentioned sample supplying means can be equipped to the positive electrode EZ2 on the Z-axis instead of the insulating holder 23.

In a case of releasing the sample A, the sample A is charged, for example, by heating, and then attractive force is generated for the sample A by electrostatic field in the direction of an arrow as shown in FIG. 9. Next, by electrically charging the solenoid 63, the plunger 64 is attracted toward the iron core 65 and goes up as shown in FIG. 9(*b*), whereby the holder pieces 67*a* and 67*a* are allowed to move in the opening direction by separating from the edge of the aperture 61, and start to release the sample A at the same time.

The chuck 67 goes down together with the plunger 64 according to the elasticity of the helical compression spring 68 by interrupting the electrical charge to the solenoid 63 successively to the start of releasing the sample A. In this time, the chuck 67 releases the sample A at the same time of the closing action of the holder pieces 67*a* and 67*a* as shown in FIGS. 9(*c*) and (*d*), and the chuck 67 is finally housed in the casing 60 through the aperture 61 as shown in FIG. 9(*e*).

It is possible to release the sample A without rotation it by using the aforementioned sample supplying means. Namely, if the chuck of opening type is used in the zero-gravity space, there is high possibility of giving rotation to the released sample according to uneven contact of the sample with the opening chuck since the contact between the sample and the chuck on the whole is not always uniform, and it becomes difficult to obtain uniform composition owing to centrifugal force caused by the rotation when the sample is rotated. Accordingly, in this electrostatic levitation furnace 1, the chuck 67 is so designed as to release the sample A without rotation by actuating the one pair of holder pieces 67*a* and 67*a* in the closing direction.

The released sample A is maintained in the levitation state between the electrodes disposed on the three axes similarly to the previously mentioned example, and subjected to heating by laser beams. In this time, since the three pairs of electrodes EZ1, EZ2, EX1, EX2, EY1 and EY2 which are equivalent in their generative electrostatic fields are adopted in this electrostatic levitation furnace 1, the controlling forces in the directions of three axes caused by the respective electrodes become uniform and the sample A is securely maintained in the levitation state in the zero-gravity space.

Figure 10:
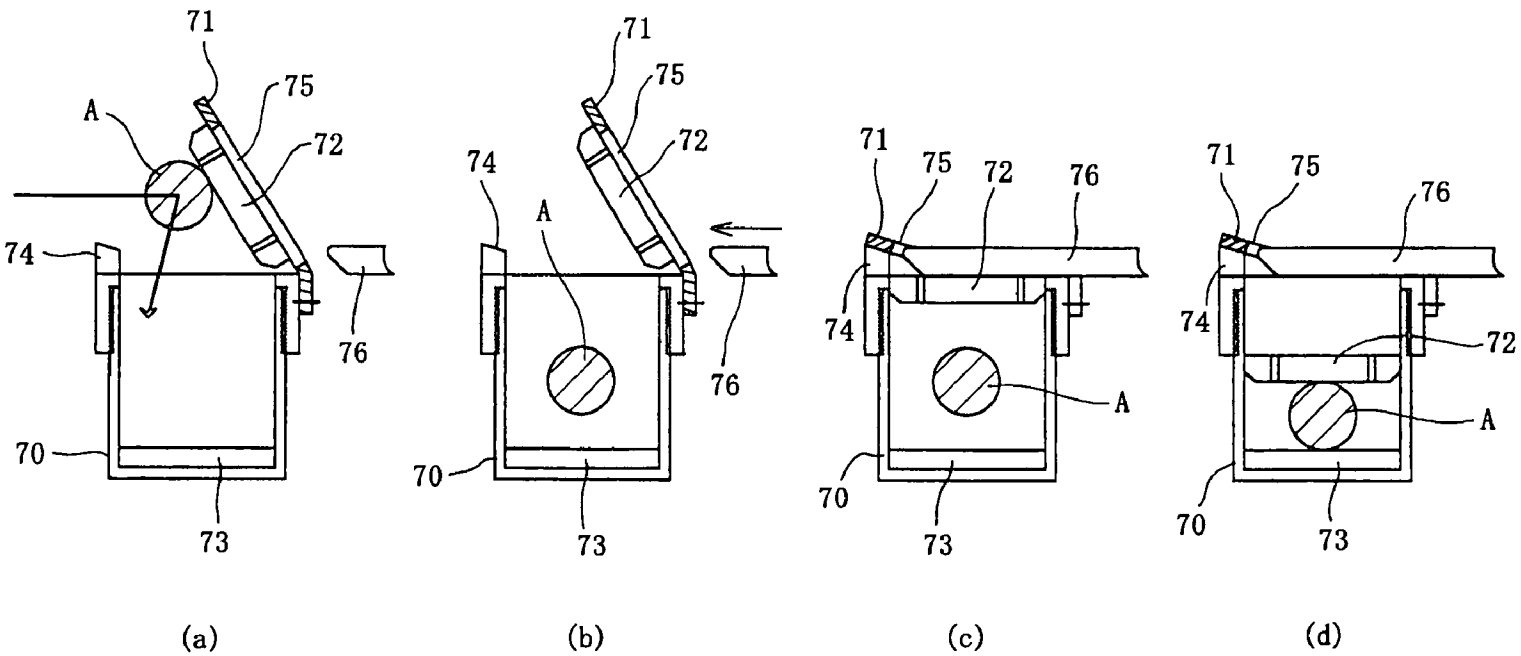
FIGS. 10(*a*)~(*d*) are sectional views explaining a process for collecting the sample.

FIG. 10 is a drawing for explaining another example of the collecting means for the sample A. The sample collecting means shown in FIG. 10 is attached with a lid 71 to one side of the upper part of a case 70 made of heat-resisting glass so as to swing freely, and disposed detachably with a reflector plate 72 made of heat-resisting resin on the under face of the lid 71. The case 70 is disposed with a buffer plate 73 made of heat-resisting resin on the bottom thereof, and provided protrudingly with a stopper 74 to be in contact with the top end of the lid 71 at the other side of the upper part of a case 70. Further, the lid 71 is formed with an opening 75 from the base end to the top end thereof, and disposed with a pusher bar 76 correspondingly to this opening 75 so as to move in parallel with the upper edge thereof.

In the aforementioned sample collecting means, the sample A finished with the heating process is pressed by the manipulator or the like, and contained into the case 70 after striking against the reflector plate 72 as shown in FIG. 10(*a*). After this, when the pusher bar 76 is moved forwardly with another manipulator or the like as shown in FIG. 10(*b*), the pusher bar 76 comes in contact with the reflector plate 72 through the opening 75, thereby swinging the lid 71 in the closing direction together with the reflector plate 72.

In the process of travel of the pusher bar 76 to the forward limit, the reflector plate 72 is removed from the lid 71 by the pusher bar 76 continuously going forward after the lid 71 is restricted to swing by the stopper 74, and the reflector plate 72 closes up the upper side of the case 70 tightly as shown in FIG. 10(*c*). After this, when the inside of the vacuum chamber 3 is recovered into the predetermined atmospheric pressure, the reflector plate 72 shifts into the bottom side according to the difference between internal and eternal pressure of the case 70 as shown in FIG. 10(*d*), so that the sample is held between the reflector plate 72 and the buffer plate 73.

Although it is impossible to successively supply and collect the sample A by the sample supplying means and the sample collecting means as described in this example, the electrostatic levitation furnace 1 is provided with the detachable cage 7 in the vacuum chamber 3, and it is possible to easily supply and collect the new sample A comparatively by disposing the respective means so as to be detachable from the cage 7.

In addition to the above, although the furnace 1 is structured so that the sample A is charged by heating with laser beams irradiated from the opening 19 of the negative electrode EZ1 on the Z-axis and molten by heating with laser beams irradiated from the laser irradiators Q1 to Q4 disposed in the four points in the aforementioned respective examples, it is also possible to integrate one of four laser irradiators Q1 to Q4 with the negative electrode EZ1 and use this laser irradiator both for electrification and melting. Adopting such the construction, the space area can be saved by the integration of the laser irradiators, consequently the degree of freedom is further improved in distribution of the other electrodes, the laser irradiators or the other apparatuses.

Figure 11:
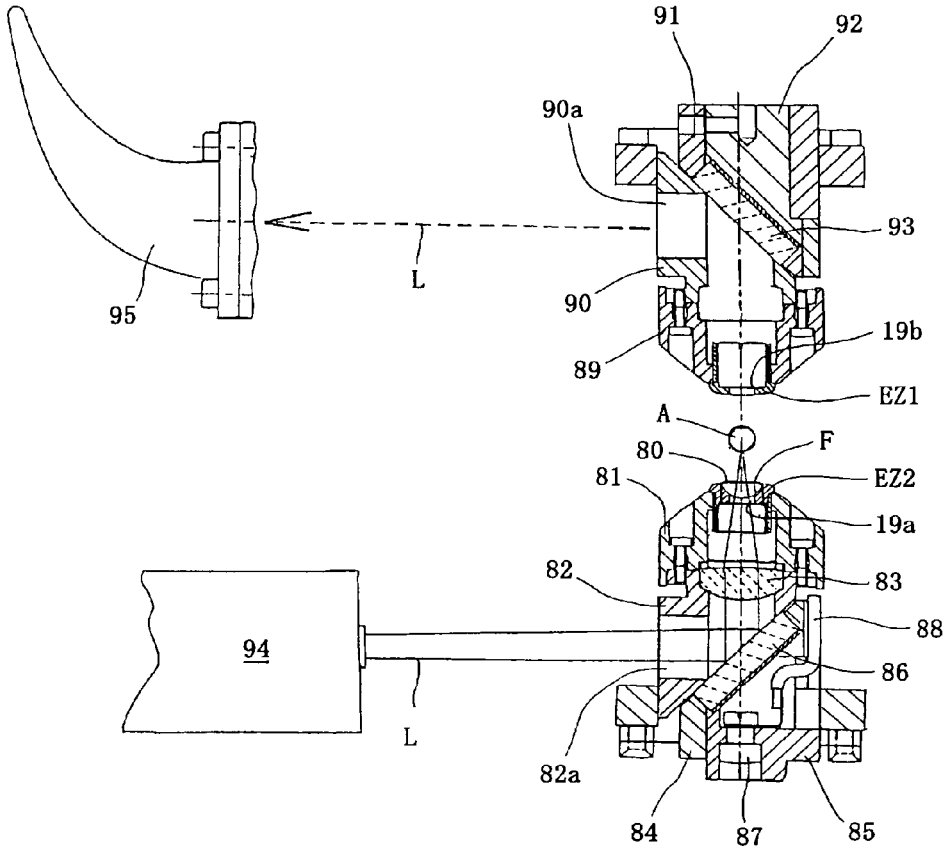
FIG. 11 is a sectional view of the necessitated portion explaining another example of the electrostatic levitation furnace according to this invention.
Figure 12:
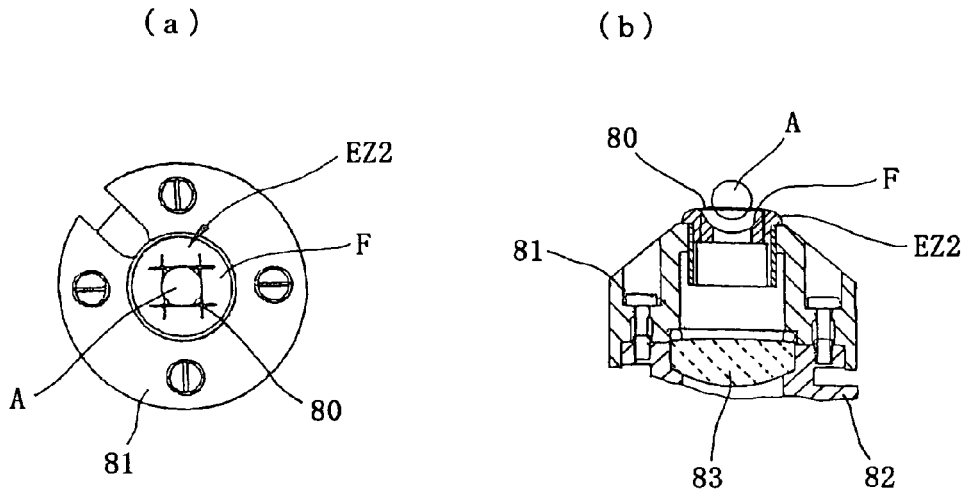
FIGS. 12(*a*) and (*b*) are a plan view and a sectional view showing a state of placing the sample on the holding means of the positive electrode shown in FIG. 11, respectively.

FIG. 11 and FIG. 12 are drawings for explaining another example of the electrostatic levitation furnace according to this invention. The electrostatic levitation furnace in this example is provided with electrodes EZ1 and EZ2 opposed to each other on the vertical axis (Z-axis) in the gravitational field, and equipped with an opening 19*a* for irradiating laser beams to the positive electrode EZ2 on the lower side.

The positive electrode EZ2 is formed by plating a material made of tough pitch copper with gold and subjected to mirror finish, the top end face F of the electrode EZ2 is formed in a nearly hemispherical concave shape, and formed with the opening 19*a* in the center thereof. The positive electrode EZ2 is further provided with a net-like shaped holding means 80 made of tungsten as a means for placing the sample A, and so designed as to hold the sample A in a state separated from the top end face F by this holding means 80 as shown in FIG. 12.

The above-mentioned positive electrode EZ2 is secured to a hollow electrode base 81 opened in the vertical direction. The electrode base 81 is connected with a hollow-shaped lens holder 82 opened in the vertical and lateral directions. The lens holder 82 maintains a condenser lens 83 together with the electrode base 81 and maintains a reflector 86 in an inclined state by a mirror presser 84 and a holder block 85 fixed on the lower side thereof. Further, the holder block 85 is provided with a power-leading terminal 87, and this power-leading terminal 87 is connected to the positive electrode EZ2 through a lead wire 88 and so on.

On the other side, the negative electrode EZ1 on the upper side has similarly an opening 19*b* at the center, and secured to a hollow electrode base 89. This electrode base 89 is connected to a lens holder 90 opened in the vertical and lateral directions. Furthermore, a reflector 93 is maintained to the lens holder 90 in an inclined state by a mirror presser 91 and a holder block 92 fixed on the upper side of the lens holder 90.

The aforementioned positive electrode EZ2 and negative electrode EZ1 are used for the upper and lower electrodes opposed with each other on the vertical axis in the electrostatic levitation furnace as mentioned in the previous example, in this case these electrodes are disposed so that a lateral opening 82*a* of the lens holder 82 of the positive electrode EZ2 may be opposed to a laser emitter 94 or an optical path from the laser emitter 94, and a lateral opening 90*a* of the lens holder 90 of the negative electrode EZ1 may be opposed to a laser damper 95 or an optical path extending to the laser damper 95.

In the electrostatic levitation furnace having the aforementioned construction, laser beams L radiated from the laser emitter 94 is introduced into the lateral opening 82*a* of the positive electrode EZ2, and this laser beams L is collected by the condenser lens 83 after being reflected in the upward direction by the reflector 86, whereby the sample A is irradiated with laser beams L from the under side thereof. In a case where the sample A moves laterally and deviates from laser beams L at the time of making the sample A in the levitation state, laser beams L is introduced into the negative electrode EZ1, and reflected toward the laser damper 95 through the reflector 93.

The above-mentioned electrostatic levitation furnace is suitable for performing heating process in the gravitational force to the sample A containing high-melting point metal as the main components, for example. In order to carry out this heating process, the sample A is placed on the holding means 80 as shown in FIG. 12 and heated up to a temperature lower than the melting point (for example, 1200° C. or so) by irradiating laser beams L from the lower side, thereby removing low-melting elements contained in the sample A (baking).

In this electrostatic levitation furnace, since the top end face F of the positive electrode EZ2 is formed in the hemi-spherically concave shape, the radiant heat is transferred efficiently to the sample A by the top end face F (concave shape), whereby heating efficiency is improved and the sample A can be heated up to the desired temperature in a short time. Further, the holding means 80 is able to hinder securely an accident such that the molten sample A sticks to the surface of the positive electrode EZ2, thereby preventing the positive electrode EZ2 from the stain and the thermal injury of the electrode face.

Furthermore, in a case of heating the sample A in this manner, it is possible to make the sample A hard to stick to the holding means 80 by radiating laser beams L in a pulse mode and heating the sample A strikingly by this pulsed laser beams L. The sample A is similarly enabled to be hard to stick to the positive electrode EZ2 even when the holding means 80 is not provided.

Subsequently, in the electrostatic levitation furnace, the sample A is made into the levitation state between the electrodes EZ1 and EZ2 (EX1 and EX2, EY1 and EY2) after properly cooling it, and then the sample A is molten by heating with laser beams L irradiated from a single or plurality of the laser irradiator(s).

In this electrostatic levitation furnace, it is possible to carry out the heating (baking) and the melting of the sample A successively and possible to reduce time required for melting the sample A after making it in the levitation state by disposing the negative electrode EZ1 and the positive electrode EZ2 at the upper and the lower positions on the vertical axis and irradiating laser beams to the sample A from the positive electrode EZ2 on the lower side as mentioned above. Concretely, it takes 5 minutes or more to melt the sample A in conventional art, but it is possible to melt the sample A for several seconds to several tens of seconds, and possible to reduce time required for melting remarkably in this electrostatic levitation furnace.

Moreover, in this electrostatic levitation furnace, pressure of laser acts in the direction in which the gravity is cancelled in the case of making the sample A into the levitation state, and it is possible to reduce an electrostatic force required for levitation, in other words possible to make the heavier sample A in the levitation state by the same electrostatic force. Further, although the spherical sample is generally used in the conventional furnace, it is also possible to use the sample other than in spherical shape in this electrostatic levitation furnace since the electrification of the sample A is maintained effectively. Accordingly, the sample A becomes unnecessary to be form in the spherical shape. Additionally, the moment when the sample A gets to melt can be judged visually and very easily because the sample in any shape excepting the spherical one changes into spherical shape at the time of the melting.

Although the construction in which the laser irradiator is incorporated to the positive electrode EZ2 on the lower side is explained in this example, it is also possible to dispose these apparatuses separately and irradiating laser beams from the under side of the sample A. In this case, laser beams may be irradiated from the position directly or diagonally below the sample A, further may be irradiated from a plurality of positions. When laser beams are irradiated to the sample A from, for example, the three points on the diagonally under side, the sample A is heated similarly in the case of irradiating laser beams from the just under side of the sample A. In such the manner, it is possible to similar effects to the aforementioned example even in the case of separating the laser irradiator from the electrode.

INDUSTRIAL APPLICABILITY

According to this invention, in the electrostatic levitation furnace for making the sample into the levitation state between the electrodes, the accessible direction for the sample A, such as the heating of the sample, the position detection, the temperature measurement, the illumination, the photographing and the like becomes multiple, in addition to the generation of the electrostatic field from three directions for the sample A, accordingly it is possible to improve the degree of freedom of the distribution of various apparatuses in spite of the small body and further possible to deal with the increase of the apparatuses as compared with the conventional case of accessing the sample on the same plane.

Further, the interference between the electrodes and the various apparatuses can be easily avoided according to the multiplication of the accessible direction for the sample, so that it is possible to use three pairs of electrodes equivalent in their electrostatic field intensity for the purpose of making the controlling forces uniform, and possible to properly dispose the plural laser irradiators for the purpose of improving the heating performance. Furthermore, it is possible to obtain the sufficient vacuum atmosphere even by the small-sized vacuum system according to miniaturization of the vacuum chamber, and it is easy to introduce the manipulator or the like for performing proper operation against the sample between electrodes because of short distance from the sample. According to these advantages, it is very suitably used in the spacecraft in which there is severe restriction in size and weight.

In the preferred embodiment of the electrostatic levitation furnace according to this invention, which is adopted with three pairs of electrodes equivalent in their electrostatic field intensity, it is possible to make the controlling forces uniform between the respective electrodes, the sample can be securely maintained in the levitation state at the predetermined position, thereby enabling the heating process satisfactory.

In another preferred embodiment of the electrostatic levitation furnace according to this invention, it is possible to very easily change the electrodes according to size of the sample or so by preparing the plural cages provided with the electrodes differing in size or distance of them in advance. Further, the cage can be attached with apparatuses other than the electrode, and it is possible to easily set parts to be disposed in the vicinity of the sample such as a condenser lens of laser beams or the like.

In the other preferred embodiment of the electrostatic levitation furnace according to this invention, in which the electrodes are detachable from the cage, it is possible to very easily change the electrodes according to size of the sample or so by using the singular cage.

Further, in the other preferred embodiment of the electrostatic levitation furnace according to this invention, in which the cage is disposed with the power terminals, the cage becomes more suitable to be dispose with the electrodes and the apparatuses required for power supply, and it is also possible to easily carry out the wiring work and so.

Furthermore, in the other preferred embodiment of the electrostatic levitation furnace according to this invention, it is possible to heat the sample uniformly and possible to form more satisfactory crystal because the laser irradiators to heat the sample are disposed at points corresponding to the respective apexes of the triangular pyramid having the center at the position where the sample is to be levitated.

In the other preferred embodiment of the electrostatic levitation furnace according to this invention, in which the laser irradiator is equipped to one of electrodes, it is possible to successively carry out the electrification of the sample and the levitation of the sample between electrodes by heating with laser beams in the case of subjecting the sample to the heating process especially in the gravity. Further, it is also possible to incorporate one of laser irradiators disposed to the respective apexes of the triangular pyramid to the electrode, in this case, the space area can be saved according to the incorporation and it is further increase the degree of freedom in distribution of the other electrodes, the laser irradiators or the other apparatuses.

Moreover, in the other preferred embodiment of the electrostatic levitation furnace according to this invention, the sample can be released between the electrodes without rotation in a case of being used especially in the non-gravitational field, and it is possible to contribute to the satisfactory crystallization by subjecting the sample to the heating process or the like without receiving influence of the centrifugal force.

Furthermore, in the other preferred embodiment of the electrostatic levitation furnace according to this invention, since the heating is done by irradiating laser beams from the under side of the sample, the molten sample becomes difficult to stick on the electrode surface and the electrode face can be prevented from the stain and the thermal injury. Further, because the laser pressure acts in the direction in which the gravity is cancelled and the electrification of the sample is maintained effectively in the case of making the sample into the levitation state, it is possible to reduce the electrostatic force or increase the sample weight and the sample in a shape other than spherical is enabled to be used. In the case of using the sample in such the shape, the sample changes into spherical shape at the same time of melting, therefore it is possible to visually and very easily judge the moment when the sample A gets to melt. Additionally, it is possible to reduce time required for melting the sample after making it in the levitation state by heating the sample in the levitation state after the heating (baking) in addition to the laser irradiation from the under side.

In the other preferred embodiment of the electrostatic levitation furnace according to this invention, the top end face of the electrode is formed in the hemi-spherically concave shape, therefore the radiant heat can be transferred efficiently to the sample and it is realize improvement of the heating efficiency and the further reduction of the melting time.

Furthermore, in the other preferred embodiment of the electrostatic levitation furnace according to this invention, it is possible to securely hinder the accident such as sticking of the molten sample on the electrode surface and possible to improve the preventing function of the stain and the thermal injury of the electrode surface by the holding means disposed to the lower side electrode.

The invention claimed is:

1. An electrostatic levitation furnace for generating electrostatic field between electrodes disposed in a vacuum chamber and making a charged sample into a levitation state in the electrostatic field between the electrodes, said furnace comprising:

three pairs of electrodes opposed to each other respectively on three axes perpendicularly intercepting each other at a position where the sample is to be levitated in the vacuum chamber; and a plurality of access ports disposed three-dimensionally to said vacuum chamber and directed to the position of said levitating sample.

2. An electrostatic levitation furnace as set forth in claim 1, wherein said three pairs of electrodes are equivalent in their electrostatic field intensity.

3. An electrostatic levitation furnace as set forth in claim 1, wherein said vacuum chamber is detachably disposed with a cage therein, and said respective electrodes are provided to the cage.

4. An electrostatic levitation furnace as set forth in claim 3, wherein said respective electrodes are detachable from the cage.

5. An electrostatic levitation furnace as set forth in claim 3, wherein said cage is provided with a power terminal.

6. An electrostatic levitation furnace as set forth in claim 1, wherein said furnace is provided with laser irradiators disposed at respective points corresponding to apexes of a triangular pyramid of which center coincides with the position of said levitating sample for irradiating laser beams against the sample.

7. An electrostatic levitation furnace as set forth in claim 1, wherein said furnace is provided with a laser irradiator disposed to one of said electrodes for irradiating laser beams against the sample.

8. An electrostatic levitation furnace as set forth in claim 1, wherein said furnace is provided with a chuck for holding the sample to be released between the electrodes, and said chuck is provided with a pair of holder pieces energized in a closing direction for pinching the sample therebetween.

9. An electrostatic levitation furnace as set forth in claim 7, wherein said laser irradiator is disposed on the lower electrode between vertically opposed electrodes in a gravitational field.

10. An electrostatic levitation furnace as set forth in claim 9, wherein said lower electrode is provided with a concave face having a nearly hemispherical shape at a top end face thereof.

11. An electrostatic levitation furnace as set forth in claim 9, wherein said lower electrode is provided with a holding means having net-like shape for placing the sample thereon.

* * * * *